United States Patent [19]

Sakurai Hidetoshi

[11] Patent Number: 4,966,116

[45] Date of Patent: Oct. 30, 1990

[54] ELECTRONIC CONTROL IGNITION SYSTEM FOR INTERNAL COMBUSTION ENGINES

[75] Inventor: Sakurai Hidetoshi, Kawagoe, Japan

[73] Assignee: Honda Giken Kogyo Kabushiki Kaisha, Tokyo, Japan

[21] Appl. No.: 343,873

[22] Filed: Apr. 27, 1989

[30] Foreign Application Priority Data

May 9, 1988 [JP] Japan ..... 63-112240

[51] Int. Cl.[5] ..... F02P 9/00

[52] U.S. Cl. ..... 123/418; 123/617

[58] Field of Search ..... 123/418, 422, 476, 406, 123/414, 416, 417, 617, 602; 364/431.04

[56] References Cited

U.S. PATENT DOCUMENTS 4,509,482 4/1985 Minner et al. ..... 123/418
4,671,237 6/1987 Miura et al. ..... 123/418
4,809,661 3/1989 Kinoshita et al. ..... 123/418
4,854,284 8/1989 Hara et al. ..... 123/418
4,854,285 8/1989 Kanno et al. ..... 123/418

*Primary Examiner*—Raymond A. Nelli

[57] ABSTRACT

An electronic control ignition system, for internal combustion engines, is disclosed in which a rotation angle of a crank shaft of an engine is calculated. The angle is calculated based on a crank angle signal generated every time the crank shaft rotates by a certain angle. Further based on the calculation result, ignition timing is controlled. The control is made to obtain an optimum ignition timing. This optimum ignition timing is based on one train of signals generated every time the crank shaft of the engine rotates by a certain angle, and (n/2−1) (n is an even number equal to or larger than 4) identical train of signals, generated subsequently with a phase delay of 1/n wavelength.

38 Claims, 11 Drawing Sheets

| FLAG \ CYL NO. | 1 | 2 | 4 | 5 | 3 |
|---|---|---|---|---|---|
| CYL1NF | 1 | – | 0 | – | 1 |
| CYL1PF | 0 | – | 1 | – | 1 |
| CYL2NF | – | 1 | – | 0 | – |
| CYL2PF | – | 0 | – | 1 | – |

ELECTRONIC CONTROL IGNITION SYSTEM FOR INTERNAL COMBUSTION ENGINES

BACKGROUND OF THE INVENTION 2. (Field of the Invention)

This invention relates to an electronic control ignition system for internal combustion engines, which electrically determines an ignition timing in accordance with a running condition of the engine.

2. (Related Background Art)

In the conventional electronic control ignition system for internal combustion engines which electrically determines an ignition timing in accordance with a running condition of an engine, a rotational angle of a crank shaft is detected in an angle pulse by a rotational angle detecting device. Based on the detected rotational angle, an ignition timing or a time during which a current is being supplied to the primary side of an ignition coil (hereinafter called current charging time) is calculated. Accordingly, higher resolution of the rotation angle of a crank shaft results in a more precise control of the ignition timing of an internal combustion engine in accordance with a running condition thereof. Taking this fact into account, devices have been made in order to improve the resolution of the rotation angle.

In a rotation angle detector as one of such systems, slits corresponding to, e.g., crank angle are formed on the periphery of a disk, such that a slit is detected to determine an ignition timing. However a problem of this system is that a numerous amount of slits have to be formed on the disk in order to obtain high resolution. Taking into account the ability of machining such a disk, that of sensing the slits and the durability of such a disk, such disk is not practical.

A photoelectric rotation angle detector has also been proposed. In this detector, a rotary disk having a required number of through holes formed on the periphery is mounted on a crank shaft. Further, light emitting element and a light receiving element are disposed at opposite positions where both elements come into alignment with each other through a through hole so that, based on interruptions of the light from the light emitting element, a rotation angle of the crank shaft is calculated. In this system, in order to prohibit adjacent ones of the electric pulse signals corresponding to the rotation angles of the crank shaft from interferring with each other, it is necessary to make the interval between each through hole and its adjacent one large to some extent. The disk has to be accordingly large sized and resultantly the rotation angle detector becomes large.

In addition, there is a system in which a reference angular position is changed selectively in accordance with the value of a calculated ignition lead angle (Japanese Patent Laid Open Publication No. 9656/1981).

In this system, an ignition lead angle indicative of an optimum ignition timing for a running condition of an internal combustion engine is calculated. Then, based on the calculated ignition lead angle, an ignition timing data indicative of a period of time from a time when the crank shaft of the engine has reached a reference angular position to an optimum ignition timing is calculated. Subsequently, when an instruction of an ignition timing of the engine is supplied, based on the calculated ignition lead angle, the reference angular position is selectively changed. In this system as well, a plurality of projections are provided on a disk, spaced from each other by 30°, and a projection is detected by a magnetic pickup sensor. Accordingly this device has similar problems of the above described systems.

In addition, there is a system in which an angle signal indicative of an ignition timing is divided into an upper position and a lower position. The positions are calculated based on angle signals of a crank shaft having different frequencies to thereby determine an ignition timing. However, this system has problems in that in order to increase the frequencies of the angle signals of the crank shaft, a multiplying circuit having a complicated circuitry is necessary. Further, in order to increase a multiplier and to perform the control with high resolution, a high frequency emitting source is necessary, etc.

SUMMARY OF THE INVENTION

There exists a characteristic that the resolution of the rotation angle of the crank shaft, in controlling the ignition timing of an engine, is high for smaller rotation numbers of the engine. Conversely, it may be low for larger rotation numbers of the engine. This is due to the fact that since the engine tends to have stable running conditions as its rotation number becomes larger, and the crank shaft takes a shorter period of time to rotate by a required angle. Thus, an error which may take place will be of very little influential. Further, contrary to this, since the engine has relatively unstable running conditions for its smaller rotation numbers, and the crank shaft takes a relatively longer period of time to rotate by a required angle, an error of an ignition lead angle due to changes of a running condition of the gives more influence on the run of the engine. Thus, it is necessary to perform the control with little error at relatively high resolution.

In view of these problems of the prior art, this invention has been developed.

An object of this invention is to provide an electronic control ignition system of internal combustion engines in which one train of signals generated every time a crank shaft rotates by a required angle, and at least one train of signals generated subsequently with a certain phase delay are used so as to form relatively simple crank angle signal units, and further, different resolutions of the rotation angle of the crank shaft are used in accordance with speed modes (e.g., high speed condition, medium speed condition and low speed condition), whereby the precision, simplicity and reliability of the system are improved.

According to this invention, a crank angle signal generated every time the crank shaft rotates by a certain angle is detected and an ignition timing is controlled based on the detected crank angle signals. The control obtains an ignition timing, based on one train of signals generated every time the crank shaft of the engine rotates by a certain angle, and (n/2-1) (n is an even number equal to or larger than 4) train of signals generated subsequently with a phase delay of 1/n wavelength. Consequently, using comparatively simple crank angle signal systems, resolutions can be assigned suitably to different speed. Thus, resultantly, accuracy and reliability of systems can be improved, and the systems can be simplified.

In other words, for the low speed mode, where engine rotation numbers tend to fluctuate, high resolution of precision n times that for the high speed mode (e.g., 4 time precision for the phase delay of 1/4 wavelength and time precision for the phase delay of 1/6 wavelength) can be obtained. Thus resultantly, accuracy of the system can be improved. All the engine conditions are not controlled based on signal systems of a single high resolution, but are based on precision as minimum as possible and suitable for different speed modes. Consequently, the system can be simplified.

Furthermore, in this invention, the same signal system is used in a plural number. Resultantly, even when one of the plural signal systems goes out of order, the other can be used to obtain a resolution suitable for a speed mode so as to control the ignition timing. Resultantly, reliability of system can be improved. In this case, for the medium and low speed modes, resolution of precision twice that for the high speed mode can be obtained. In this case, switching from the normal operation in which the signal systems are normal, to an operation in which the signal systems are not normal, can be taken care safely by selecting a different signal source and correcting a phase delay. Resultantly, circuitry can be relatively simple.

The present invention will become more fully understood from the detailed description given hereinbelow and the accompanying drawings which are given by way of illustration only, and thus are not to be considered as limiting the present invention.

Further scope of applicability of the present invention will become apparent from the de&ailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

Figure 5:
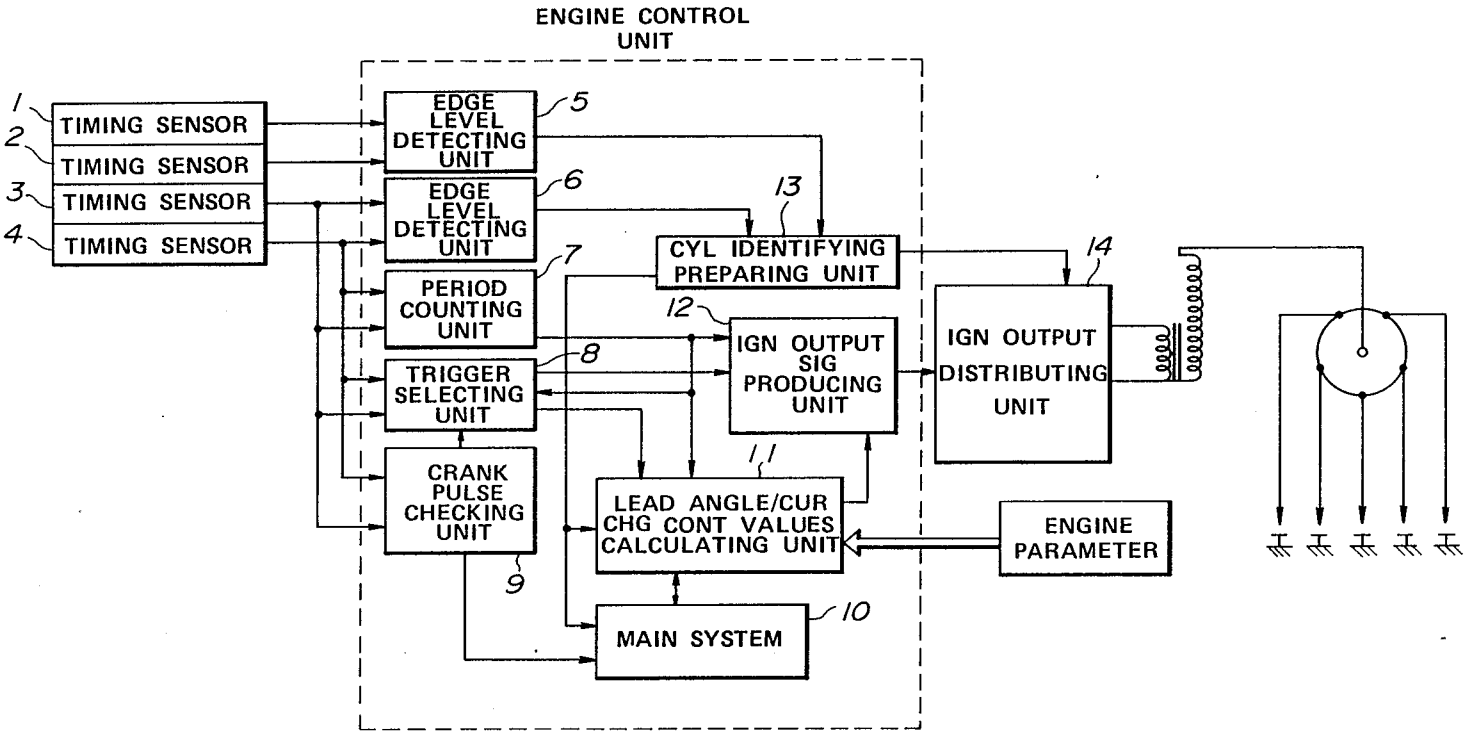
FIG. 5 is a block diagram of a control system using the embodiment of this invention.

FIG. 5 is a general block diagram of the electronic control ignition system according to one embodiment of this invention. The electronic control ignition system according to this embodiment is for use in controlling the ignition timing of, for example, a five cylinder internal combustion engine not shown. This system has four timing sensors 1 to 4. The timing sensor 1 detects a position of one of the cylinders, and the timing sensor 2 detects a position of one of the other cylinders. The timing sensors 1 and 2 are so set to generate pulses, in principle, at 90° before the Top Dead Center of their respective compression strokes (hereinafter called TDC) of the respective cylinders. The timing sensors 3,4 detect a rotation angle of a crank shaft. Further, the timing sensor 4 is set so as to generate a pulse with a certain phase delay with respect to the pulse generated by the timing sensor 3. The system has an engine control unit which performs required controls, based on the signals from the timing sensors 1 to 4, etc. The unit comprises the following devices. An edge level detecting device 5 receives pulses from the timing sensors 1,2 (hereinafter called CYL pulses) and latches the positive inversions (rises) and the negative inversions (falls) of the edges of the pulses to input the levels of the respective edges. Both pulses from the timing sensors 3,4 are supplied to an edge level detecting unit 6, a period counting unit 7, a trigger selecting unit 8 and a crank pulse checking unit 9. The edge level detecting unit 6 latches the positive inversions of the supplied pulses, and the negative inversions thereof, to input the levels of the respective edges.

The period counting unit 7 detects the edges of the negative inversions of the pulses from the timing sensors 3,4 so as to count the periods of the pulses. The trigger selecting unit 8 is supplied with a pulse period data by the period counting unit 7, while supplied with pulses based on crank angles by the timing sensors 3,4. Based on these data and pulses, it produces a trigger signal, which will be used in an ignition output signal producing unit 12 and a lead angle/current charge control values calculating unit 11, which will be described below. The crank pulse checking unit 9 checks noises based on changes in the periods of the pulses from the timing sensors 3,4, and detects the presence of extinguished pulses by monitoring the pulses interrelatively. The crank pulse checking unit 9 supplies a checking result to a main system 10, as error information, and simultaneously to the trigger selecting unit 8 as a trigger selection changing information.

A cylinder identifying data preparing unit 13 prepares a cylinder identifying data at every TDC, based on the edge and the level of a pulse corresponding to a position of each cylinder supplied by the edge level detecting unit 5, as well as the edge and the level of a pulse corresponding to a crank angle supplied by the edge level detecting unit 6. During this processing, the edges and the levels of the CYL pulses from the timing sensors 1,2 are also checked interrelatively so as to monitor the presence of extinguished pulses. The lead angle/current charge control values calculating unit II is supplied with a period data of a crank pulse by the period counting unit 7, a trigger mode selected by the trigger selecting unit 8, and a data for identifying a cylinder by the cylinder identifying data preparing unit 13. It is further supplied with various parameters of a condition of the engine, such as the absolute pressure in an intake pipe downstream of a throttle valve of the engine, the intake-air temperature, the temperature of a coolant for engine body, so that an ignition lead angle, and a current charge data are calculated.

The main system 10 is supplied with calculated information by the lead angle/current charge values calculating unit II, a cylinder identifying data by the cylinder identifying data preparing unit 13, and a crank error information by the crank pulse checking unit 9, so as to perform a fail safe control, a display control, etc. The information concerning the fail safe control is supplied to the lead angle/current charge control values calculating unit 11. An ignition output signal producing unit 12 is supplied with a crank pulse period data by the period counting unit 7, and an ignition output trigger signal by the trigger selecting unit 8. A lead angle/current charge data by the lead angle/current charge control values calculating unit II so a to produce an ignition output signal to be to an ignition output distributing unit 14, which will be described below.

The engine control unit described above is connected to the ignition output distributing unit 14. The ignition output distributing unit 14 receives cylinder identifying data from the cylinder identifying data preparing unit 13 and an ignition output signal from the ignition output signal producing unit 12, and supplies an ignition output signal to a relevant cylinder based on the cylinder identifying data. Further, the ignition output distributing unit 14 performs cylinder switching to the relevant cylinder, when the relevant cylinder starts to be supplied with, an ignition current. The ignition output signal is then supplied to a corresponding ignition coil.

Figure 1A:
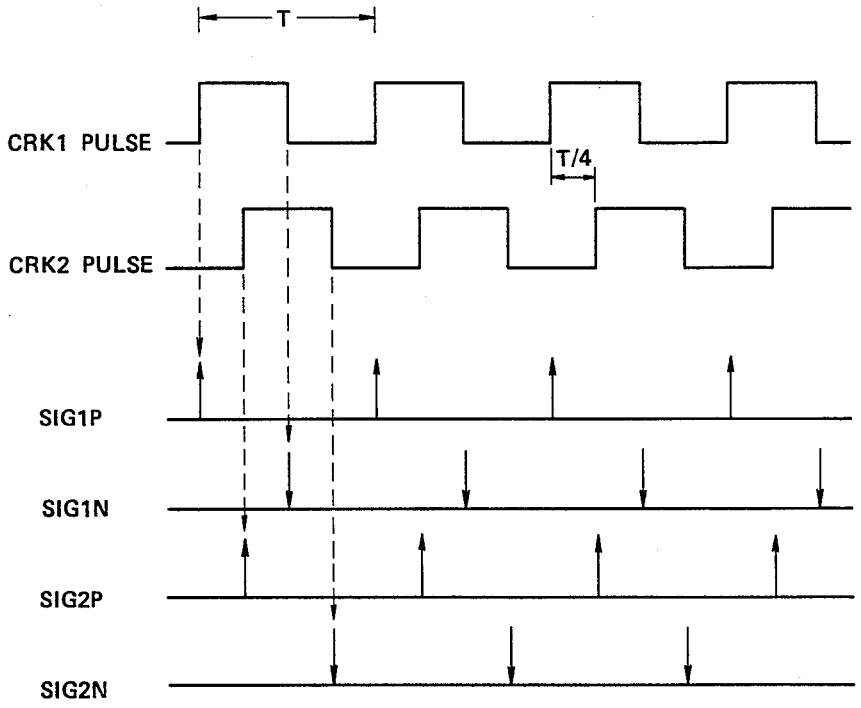
FIGS. 1*a* and 1*b* are diagrams of signal waveforms with a phase delay of 1/4 wavelength for one embodiment of the electronic control ignition system for internal combustion engines according to this invention.

The operation principle of the trigger selecting unit 8 will be explained with reference to FIGS. 1–3 by means of one embodiment of this invention, in which the pulse from the timing sensor 4 (hereinafter called CRK2 pulse) is behind the pulse from the timing sensor 3 (hereinafter called CRK1 pulse) by 1/4 wave The pulses detected by the timing sensors 3,4 are supplied to the trigger selecting unit 8 through a waveform shaping circuit, not shown. CRK2 pulse is generated behind CRK1 pulse by 1/4 wavelength. Accordingly CRK1 and CRK2 pulses are inputted to the trigger selecting unit 8 in the form, of FIG. 1A.

Figure 3:
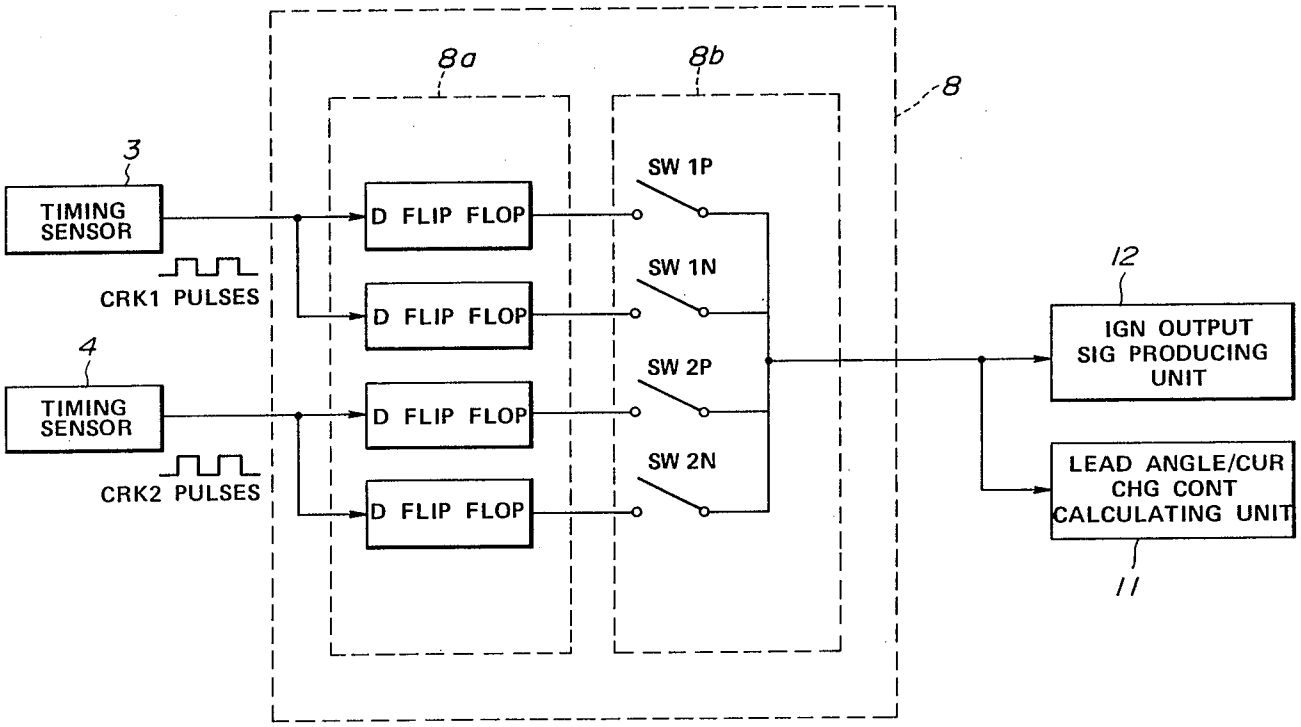
FIG. 3 is a block diagram showing the operational principle of the trigger selecting unit 8 using the embodiment of this invention.

The trigger selecting unit 8 includes, for example, a D flip flop circuit **8*a* and a gate circuit 8*b* as shown in FIG. 3. The D flip flop circuit 8*a* decomposes pulse edges of a required level into positively inversed edges and negatively inversed edges for the detection thereof. That is, as shown in FIG. 1A, the positively inversed edge of CRK1 pulse and the negatively inversed edge of CRK1 pulse are detected respectively as SIG1P and SIG1N, and the positively inversed edge of CRK2 pulse and the negatively inversed edge of CRK2 pulse are detected respectively as SIG2P and SIG2N. These signal pulses (hereinafter called basic pulses) are supplied to the gate circuit 8*b***.

The gate circuit **8*b* comprises, for example, four selective switches, SW1P, SW1N, SW2P and SW2N, which select the basic pulses one after another so as to produce an ignition output trigger signal to be supplied to the ignition output signal producing unit 12 and a calculating unit trigger signal to be supplied to the lead angle/current charge control values calculating unit 11. The ignition output trigger signal is produced so as to have a resolution suitable for a mode, based on the judgment as to whether a signal system based on a trigger selection signal supplied by the crank pulse checking unit 9 are normal or abnormal, and based on the judgment as to a running condition of the engine, i.e., high speed, medium speed or low speed condition made based on a period data from the period counting unit 7**.

Figure 1B:
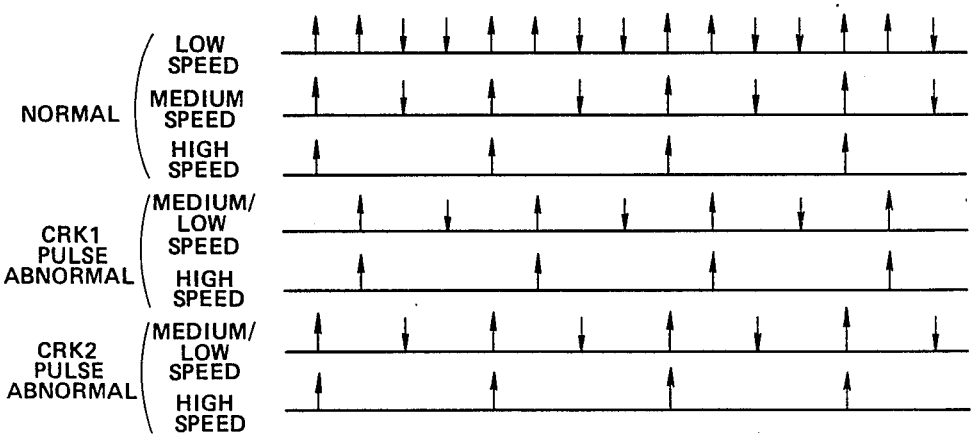

For example, when the signal system is normal, and the engine has its a low speed condition, all the four selective switches are turned on. Ignition output signals of high resolution are produced as shown in FIG. 1B by SIG1P, SIG1N, SIG2P and SIG2N. When the signal system is normal, and the engine has its high speed condition, only the selective switch SW1P is turned on, and the ignition output signal of low resolution is produced only by SIG1P. In the same way, when the signal system is normal, and the engine has its medium speed condition, SW1P and SW1N of the four selective switches are turned on, and an ignition output signal having a required resolution are produced.

When the signal system is abnormal, i.e., one of CRK1 and CRK2 pulses is not detected, as shown in FIG. 1B, the ignition timing is controlled in two trigger modes separately for the low speed and the speed conditions. For example, when CRK1 pulse is the crank pulse checking unit 9 sends out a command for selecting CRK2 pulse, and SIG2P and SIG2N, which are the basic pulses into which is decomposed CRK2 are used to produce a trigger mode. In other words, in the medium and low speed conditions, SW2P and SW2N are turned on, and an ignition trigger signal having high resolution at least for the medium speed condition with the normal signal system, can be produced. In the high speed condition, only SW2P is turned on, and a trigger signal having completely the same resolution as in the high speed condition with the normal signal system, can be produced. In this case, a resultant phase delay is compensated by the lead angle/current charge control values calculating unit II, which was supplied beforehand with a failure information. Thus, the phase delay causes no error in the ignition timing and the starting time of the current charge.

When CRK2 pulse is abnormal, the crank pulse checking unit 9 sends out a command for selecting CRK1 pulse, and SIG1P and SIG1N, which are the basic pulses into which is decomposed CRK1, are used to produce a trigger mode. In other words, in the medium and low speed conditions, SW1P and SW1N are turned on, and an ignition trigger signal having high resolution, at least for the medium speed condition with the normal signal system, can be produced. In the high speed condition, only SW1P is turned on, and a trigger signal having completely the same resolution as in the high speed condition with the normal signal system can be produced. Further, the failure information such as the presence of extinguished signals can be obtained by the crank pulse checking unit 9 monitoring respective pulses interrelatively.

Next, another embodiment of this invention in which the phase delay is 1/6 wavelength, will be explained.

Figure 2A:
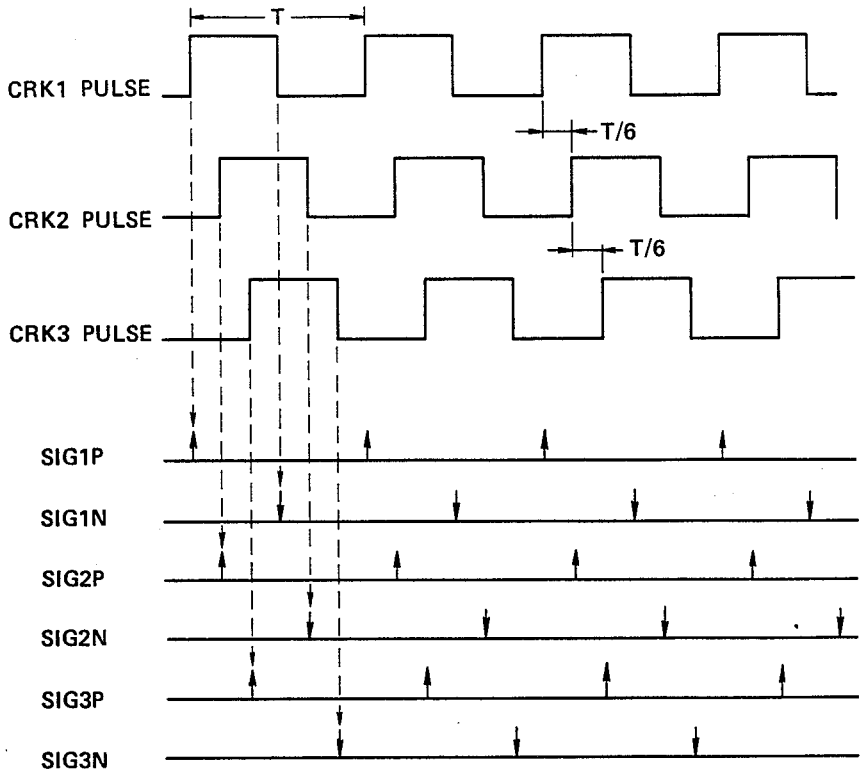
FIGS. 2*a* and 2*b* are diagrams of signal waveforms with a phase delay of 1/6 wavelength for one embodiment of this invention.

In this embodiment, as shown in FIG. 2, three forms of pulses which are generated in accordance with crank angles (hereinafter called crank pulses) are required. Accordingly the number of the D flip flops of the D flip flop circuit **8*a*, and that of the selective switches of the gate circuit 8*b*, are increased. Specifically, the D flip flop circuit 8*a*** needs three pairs of a positive inversion detector and a negative inversion detector. Accordingly, the gate circuit 8*b* needs a total of six selective switches. This arrangement enables the making six basic pulses, SIG1P, SIG1N, SIG2P, SIG2N, SIG3P, SIG3N by detecting three crank pulses. Further, the ignition output trigger signal can have, for the medium speed condition, a resolution of precision which is twice that of the high speed condition. For the low speed condition, an ignition output trigger signal can have high resolution of six times the precision.

What is important here is that the CRK2 pulse is set so as to be generated behind the CRK1 pulse by 1/6 wavelength, and the CRK3 pulse is set so as to be generated behind the CRK2 pulse by 1/6 wavelength.

Figure 2B:
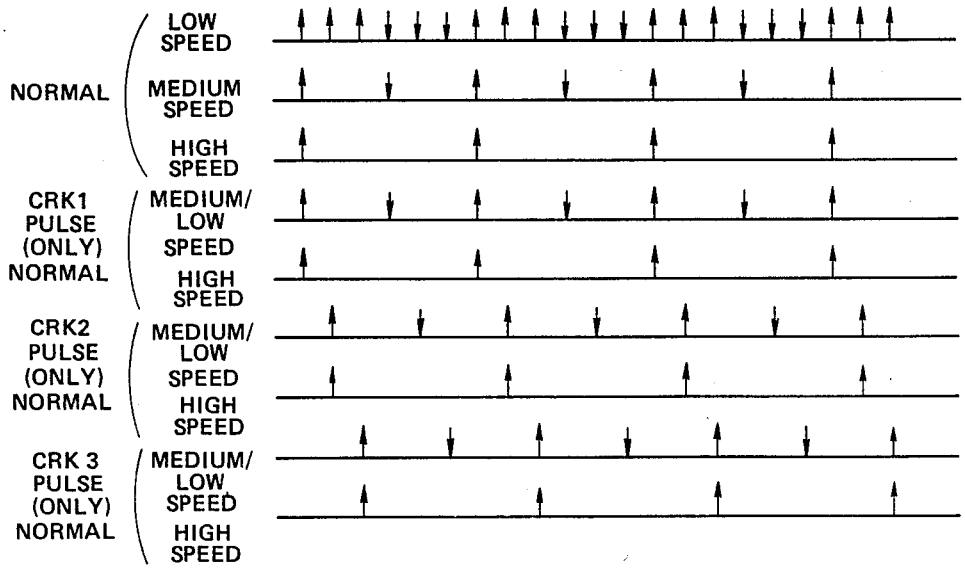

In this embodiment as well as in the former embodiment in which the phase delay was 1/4 wavelength, even if all of the signal systems should not be normal even when two of the signal systems go out of order), an ignition output trigger signal having high resolution of twice the precision is generated for the medium and low speed conditions as shown in FIG. 2B. In this case, a resultant phase delay is compensated by the lead angle/current charge control values calculating unit 11, which has been supplied beforehand with a failure information of the signal systems. Namely, when the CRK1 pulse of the three crank pulses goes out of order, and the CRK2 pulse is selected, the delay of 1/6 wavelength is compensated. Further, when the CRK3 pulse is selected, the delay of 2/6 wavelength is compensated. A command as to which crank pulse to be selected is supplied by the crank pulse checking unit 9.

Further, even though CRK1 pulses are normal, the trigger signal is produced based on only the CRK1 pulse if CRK2 pulses or CRK3 pulses are abnormal. In this case, the correction of phase delay is not necessary.

The embodiments in which the phase delay between the crank pulses are respectively 1/4 wavelength and 1/6 wavelength have been explained above. Generally in the case where the phase delay is 1/n (n is an even number) wavelength, an ignition output trigger signal having high resolution of n time precision can be produced for the low speed condition of the engine. In this case, the total number of trains of the signals is n/2. What should be noted here is that the CRK2 pulse is generated behind the CRK1 pulse by 1/n wavelength, and that the CRK3 pulse is generated behind the CRK2 pulse by 1/n wavelength, for example, one of the subsequently generated trains of signals is followed by a next train with phase delay of a 1/n wavelength. As the fail safe mechanism, if only all of the n/2 trains of crank pulses are not abnormal, an ignition output trigger signal having resolution of precision at least twice that for the high speed condition of the engine can be secured for the medium and low speed conditions. When CRK1 pulses are normal and the (n/2-1) identical pulse train of signals includes a train of signals which is not normal, or when CRK1 pulses are not normal and the (n/2-1) identical pulse train of signals includes a normal train of signals, the trigger signal is produced based on a normal pulse train of signals. In this case, the failure information can be obtained by the crank pulse checking unit 9 monitoring respective pulses interrelatively. Further, when the pulse train of signals which has phase delay is selected, the phase delay is corrected beforehand. The calculating unit trigger signal comprises the negatively inversed edge signal of the CRK1 pulse when a signal system is normal, and comprises the negatively inversed edge signal of the CRK2 pulse when CRK1 pulse is abnormal. The calculating unit is actuated after STG1L is renewed. An ignition output trigger signal thus produced is supplied to the ignition output signal preparing unit 12, and a calculating unit trigger signal is sent to the lead angle/current charge control values calculating unit 11.

Figure 4:
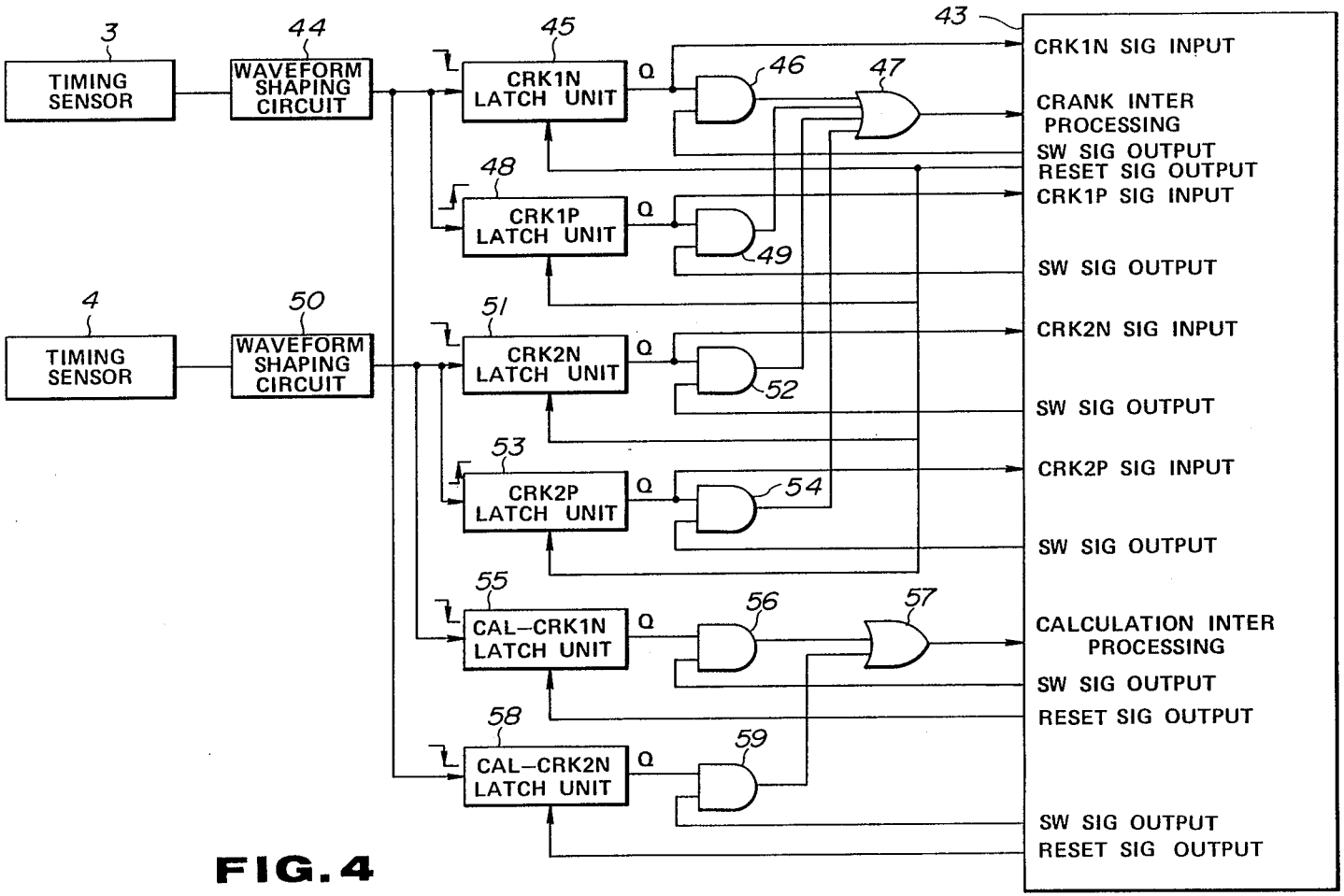
FIG. 4 is a block diagram explaining the processing steps of the trigger selecting unit of FIG. 3.

Next, the processing steps of the trigger selecting unit 8 will be explained with reference to FIG. 4. A waveform input signal from the timing sensor 3 is shaped into a square wave by a waveform shaping circuit 44. The negatively inversed edge of the signal is detected by a latch circuit (hereinafter called CRK1N latch unit) 45 for detecting only the negatively inversed edge of the CRK1 pulse. Further, the positively inversed edge of the signal is detected by a latch circuit (hereinafter called CRK1P latch unit) 48 for detecting only the positively inversed edge of the CRK1 pulse.

A signal detected by the CRK 1N latch unit 45 is supplied to CPU 43 from the output terminal Q as a negatively inversed edge signal (hereinafter called CRK1N signal). Then the CPU 43 supplies a switch signal to an AND gate 46. An output signal of the AND gate 46 becomes "1" since the AND gate 46 has been charged with an output signal "1" from the CRK1N latch unit 45, and is then supplied to an OR gate 47. The OR gate 47, which is supplied with the input signal "1", has an output signal "1" irrespective of other input signals. Then, in response to the output signal, CPU 43 instructs the ignition output signal producing unit 12 to execute crank interrupt processing.

Simultaneously, on the other hand, the CRK1P latch 48 supplies an output signal "1" to CPU 43 from the output terminal Q to input a positively inversed edge signal of CRK1 pulse (hereinafter called CRK1P signal), while the CRK1P latch unit 48 supplies a switch signal to an AND gate 49. The AND gate 49, which has been charged with an output signal "1" by the CRK 1P latch unit 48, outputs a signal "1". This output signal "1" is supplied to the OR gate 47. Accordingly the OR gate 47 has an output signal "1", and then CPU 43 instructs the ignition output signal producing unit 12 to execute crank interrupt processing. In response to a negatively inversed edge signal and a positively inversed edge signal of CRK2 pulse, respective crank interrupt processings are executed on completely the same principle. After the crank interrupt processings are completed, CPU 43 supplies reset signals to the CRK 1N latch unit 45 and the CRK 1P latCh unit 48, and both units 45,48 are thus ready for next signal inputs.

On the other hand, the negatively inversed edges of the CRK1 pulse and the CRK2 pulse are supplied respectively to a CRK1 pulse calculation latch unit (hereinafter called CAL.CRK1N latch unit) 55 and a CRK2 pulse calculation latch unit (hereinafter called CAL.CRK2N latch unit) 58 as the calculation signal. The CAL.CRK1N latch unit 55 supplies an output "1" to an AND ga&e 56 from the output terminal Q. The AND gate 56 supplies an output signal "1" to an OR gate 57 in response to a switch signal "1" from CPU 43. The CAL.CRK2N latch unit 58 supplies an output signal "1" to an AND gate 59 from &he output terminal Q. The AND gate 59 supplies an output signal "1" to an OR gate 57 in response to a switch signal "1" from CPU 43. Every time the OR gate receives an output signal "1", the OR gate sends an output signal "1" to CPU 43, and CPU 43 sends out a calculation trigger signal for causing the lead angle/current charge control values calculating unit 11 to execute an interrupt calculation of a lead angle current data.

After the interrupt calculation is over, CPU 43 supplies reset signals to CAL.CRKIN latch unit 55 and to CAL CRK2N latch unit 58. Both units 55,58 are ready for next signal inputs.

Next, the interrupt calculation of a lead angle current data made by the lead angle/current charge control values calculating unit 11 will be explained by means of one embodiment of this invention.

Figure 6:
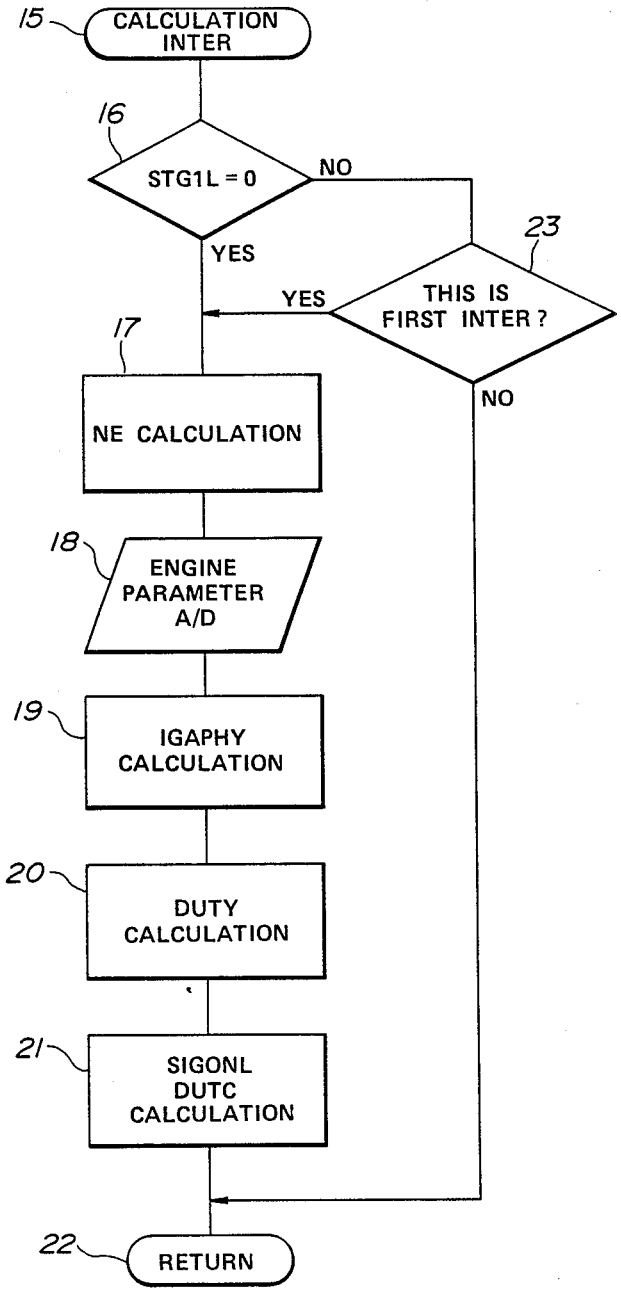
FIG. 6 is a flow chart showing the steps of interrupt processing the lead angle current charge data calculation according to this invention.

In this embodiment, A negatively inversed edge signal of CRK1 pulse is generated every time a crank shaft of the five cylinder engine rotates 36° in high speed condition of the engine, and CRK2 pulse follows the signal with a phase delay of 1/4 wavelength. First, the steps of the interrupt calculation of the lead angle current data will be explained with reference to the flow chart of FIG. 6. In Step 16, it is judged whether or not STG1L, which will be described below, is 0 at the position of a crank angle. When the answer is Yes, the processing goes to Step 17, but when the answer is No, the processing goes to Step 23, where it is judged whether or not the present interrupt is first. When the answer in Step 23 is Yes, Step 17 follows, but when the answer in Step 23 is No, Step 22 follows.

In Step 17 a rotation number of the engine NE is calculated based on a crank signal period data, and then the processing goes to Step 18. In Step 18 the analog values of engine parameters, such as the absolute pressure in the intake pipe PB, etc., are converted into digital values. Then the processing goes to Step 19. In Step 19 a lead angle control value IGAPHY is calculated, and Step 19 is followed by Step 20. However, when the CRK1 pulse is abnormal, the lead angle control value IGAPHY is an operand value plus 9°. This is the compensation of the phase delay.

In Step 20, a current charge control value DUTY is calculated based on a rotation number of the engine NE and a battery voltage VB, and then Step 21 follows. In Step 21, based on the lead angle control value IGAPHY and the current charge control value DUTY, a crank angle information (hereinafter called DUTC) which is used in calculating a current charge starting stage SGONL, and a period of time to be counted down to a current charge starting time (hereinafter called current charge timer). Then the processing proceeds to Step 22, and the program is completed.

The respective calculations of the data used in the above described processing will be further explained in detail below.

The lead angle control value IGAPHY is given based on the following formula $$IGAPHY = IGAMAP + IGACR \quad (I)$$

based on engine parameters, such as a rotation number of the engine NE, an absolute pressure in the intake pipe PB, a temperature of the engine coolant TW, etc.

In the formula (1), IGAMAP represents a basic lead angle value, which is read out from a map stored in, for example, a ROM not shown, based on a rotation number of the engine NE and an absolute pressure in the intake pipe PB. IGACR represents a compensation angle read out from a table stored in, for example, a ROM, in accordance with a temperature of the engine coolant TW, a temperature of intake-air TA, an atmospheric pressure PA, etc. The IAPHY, IGAMAP and IGACR represent angle informations with respect to crank angles in an ignition control range (72° for the five cylinder engine) by hexadecimal notation. The engine rotation number NE used in the above IGAMAP value calculation is given based on a period data supplied by the period counting unit 7. The period data is provided by a sum $ME(=ME_{40}+ME_{41}+ME_{42}+ME_{43})$ of the values $ME_{40}$ to $ME_{43}$ which are given by counting the intervals of respective four stages 0 to 3 (which will be explained below) of CRK1 pulses for the high speed condition by clock pulses with a constant period (fixed clock pulses), when CRK1 pulse is normal. However, when CRK1 pulse is abnormal, a sum of $ME(=ME_{20}+ME_{21}+ME_{22}+ME_{23})$ of the values $ME_{20}$ to $ME_{23}$ which are given by counting the intervals of respective four stages 0 to 3 (which will be explained below) of CRK2 pulses for the high speed mode by clock pulses with a constant period (fixed clock pulses). A command for this operation is supplied by the main system 10.

Next, the calculation of the current charge starting stage SGONL, and DUTC will be explained below.

The current charge starting stage, SGONL, and DUTC for the speed mode of the high speed condition, are provided by a quotient (an integer) and the remainder given by the following formula $$\{(IGAOFF+100)-IGAPHY\}/80 \quad (2).$$

In the formula (2) IGAOFF is a no current charging angle given based on the following formula $$IGAOFF=\{(100-DIGON)/100\}\times 200[\%] \quad (3)$$

and, similar to IGAPHY, represents an angle information with respect to crank angles in an ignition control range by hexadecimal notation.

In the formula (3) DIGON is a crank angle corresponding to the current charge control value DUTY, with respect to a current charge starting range 144° for the five cylinder engine). The current charge control value DUTY, is a function of an engine rotation number NE and, as described above, is read out of a table stored in, for example, a ROM. A read value is corrected by a battery voltage to be inputted. DIGON is set at 100 even when a crank angle corresponding to a current charge control value DUTY exceeds a current charge starting range (144°), so that IGAOFF becomes 0.

When the speed mode is a medium speed condition, a current charge starting stage SGONM and DUTC are provided by a quotient (an integer) and the remainder is given based on the following formula $$\{(IGAOFF+100)-IGAPHY\}/40 \quad (4).$$

As described above, IGAOFF is given by the formula (3).

When the speed mode is the low speed condition, a current charge starting stage SGONS and DUTC are provided by a quotient (an integer) and the remainder given based on the following formula $$\{(IGAOFF+100)-IGAPHY\}/20 \quad (5).$$

IGAOFF is given by the formula (3) as described above.

A lead angle control value IGAPHY, a current charge starting stage SGON, and DUTC, thus given by calculating the lead angle current charge data, are inputted to the ignition signal producing unit 12 to produce an ignition timer output value TIG and a current charge timer value TIGON.

Figure 7:
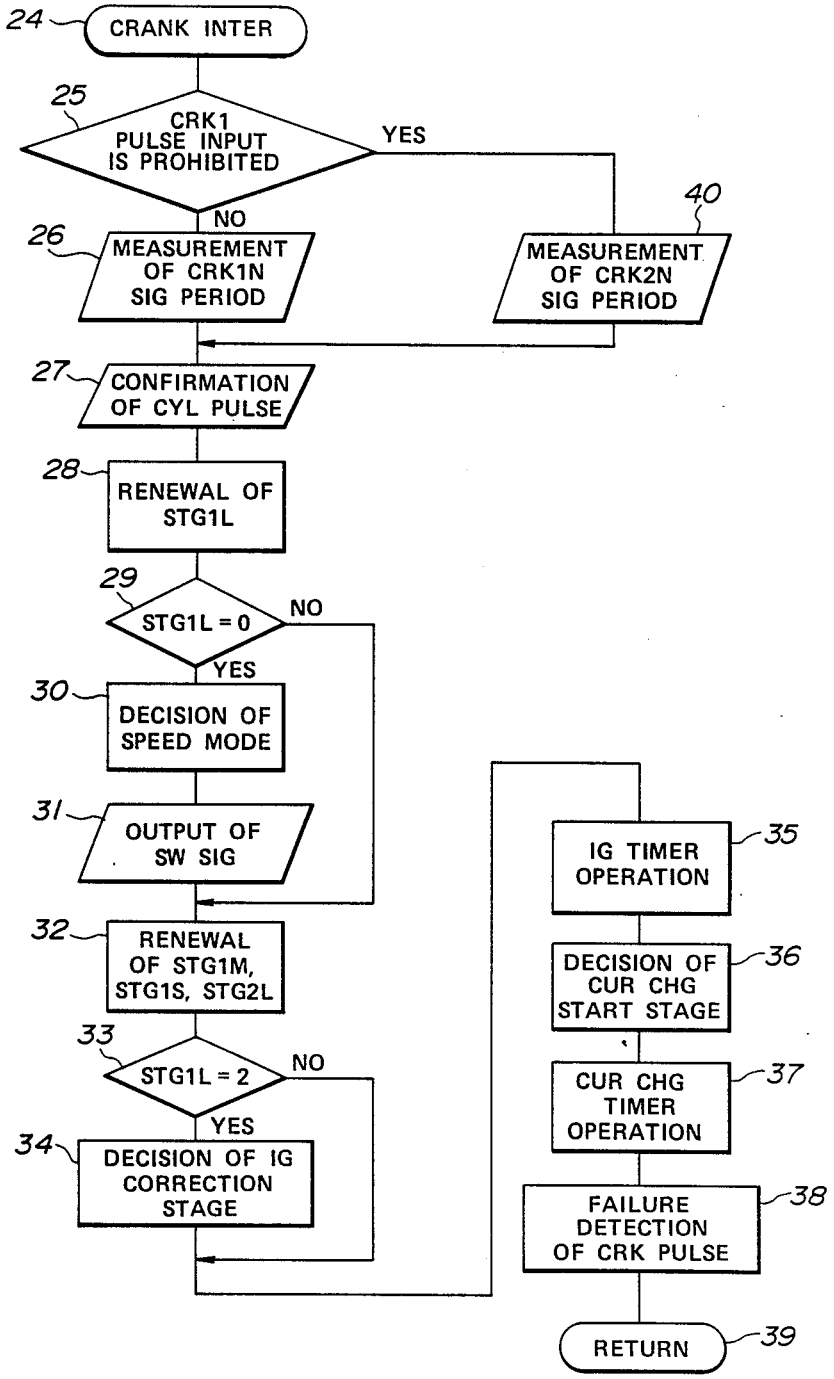
FIG. 7 is a flow chart showing the processing steps of the crank interrupt processing according to this invention.

Next, the step of the crank interrupt processing by the ignition output signal preparing unit 12 will be explained with reference to the flow chart of FIG. 7.

In Step 25, it is judged whether or not the input of CRK1 pulse is prohibited, and the answer is No, Step 26 follows. In Step 26, a period of the CRK1 pulse is measured. Then the processing goes to Step 27. When the answer in Step 25 is Yes, Step 40 follows. In Step 40, a period of CRK2 pulse is measured, and then &he processing goes to Step 27. In Step 27, an input of CYL pulse is confirmed to make sure that the engine is in a running condition Then Step 28 follows. In Step 28, STG1L is renewed, and Step 29 follows.

In Step 29 it is judged whether or not STG1L is 0. When the answer is Yes, the processing goes to Step 30, and when the answer is No, Step 32 follows. But Steps 28 and 29 are executed in response to only the negatively inversed signal of CRK1 pulse. In Step 30, a speed mode is decided, based on an engine rotation number NE and a crank failure information, and then the processing goes to Step 31. In Step 31, the output signals of the respective switches are processed. Then Step 32 follows. In Step 32, STG1M, STG1S and STG2L are renewed in accordance with a command for interrupts, and Step 33 follows.

In Step 33, it is judged whether or not STG1L is 2. When the answer is Yes, the processing goes to Step 34, and when, the answer is No, the processing goes to Step 35. However, Step 33 is executed in response to only the negatively inversed signal of the CRK1 pulse. In Step 34, an ignition correction stage is decided in accordance with a speed mode and is timely converted into an ignition timer output value. Then the processing goes to Step 35. In Step 35, an ignition timer operation is performed in accordance with the speed mode, and then Step 36 follows. In Step 36, a current charge starting stage is decided and is timely converted into a current charge timer value. Then Step 37 follows. In Step 37, a current charge timer operation is performed in accordance with the speed mode, and the processing goes to Step 38. In Step 38, failure detections are performed, for example, CRK1 pulse and CRK2 pulse are interrelatively checked. Then the program is completed.

The above described crank interrupt processing program is executed every time a crank signal is generated, and when the program is completed, the interrupt processing program of the lead angle current charge data calculation is resumed. When a crank signal is inputted during the interrupt processing program of the lead angle current charge data calculation, the crank interrupt processing has priority.

Figure 8:
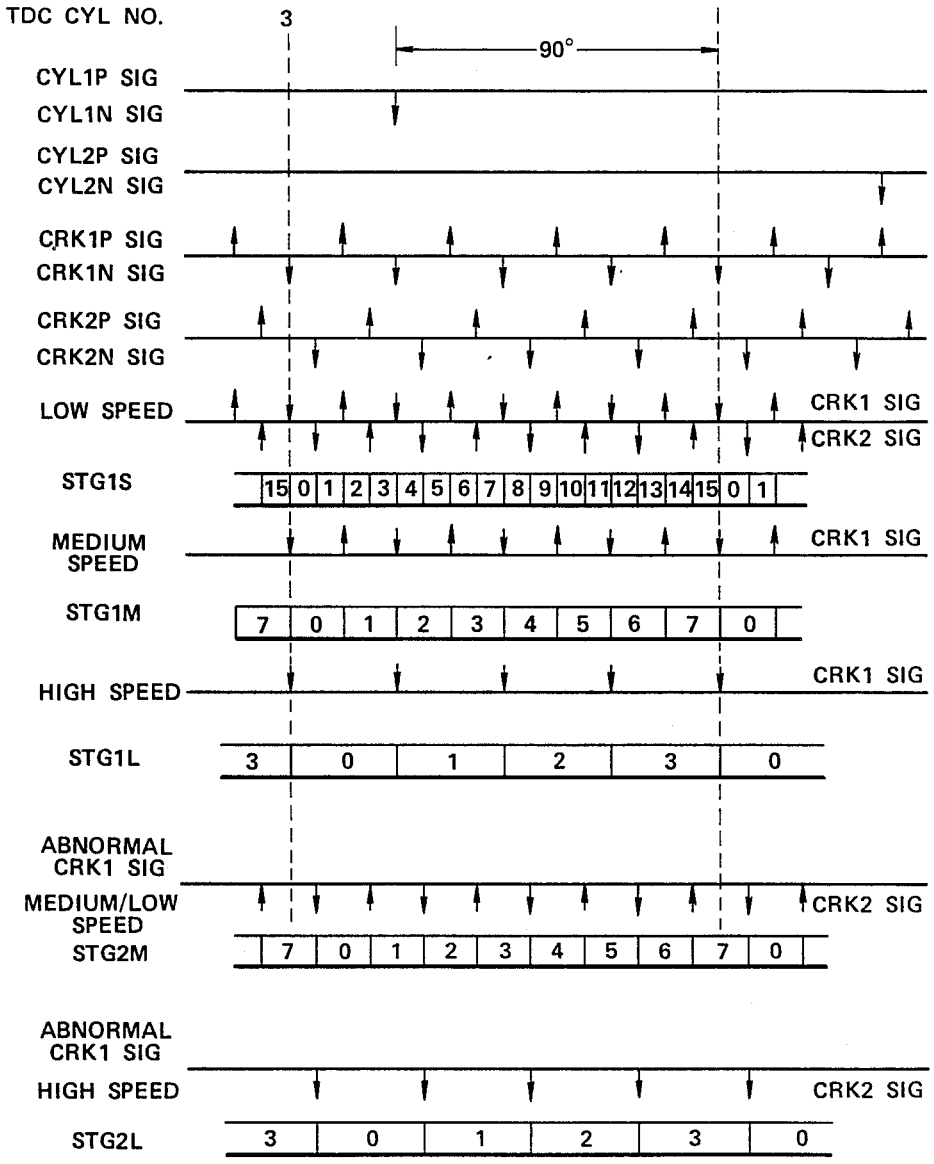
FIG. 8 is a diagram of the signal waveforms showing the stage numbers allotted to the ignition output trigger signal.

In response to a result of the above described crank interrupt processing, the numbers of stages shown in FIG. 8 are allotted to an ignition output trigger signal selected by the trigger selecting unit 8. In other words, STG1L is allotted, based on an interval between one of the negatively inversed edges of CRK1 pulse and a next one. The intervals are numbered sequentially from 0 to 3. STGIM is allotted based on an interval between one of the negatively (or positively) inversed edges of the CRK1 pulse and a next positively (or negatively) inversed edge. The intervals are numbered sequentially from 0 to 7. STGIS is allotted based on an interval between one of the negatively inversed (or positively inversed) edges of the CRK1 pulse or the CRK2 pulse and a next positively (or negatively) inversed edge. Further, the intervals are numbered sequentially from 0 to 15. STG2L are allotted based on an interval from one of the negatively inversed edges of the CRK2 pulse to a next one, and the intervals are numbered sequentially from 0 to 3 as in STG1L. STG2L stage is used for checking CRK1 pulse with CRK2 pulse. The stages 0 of STG1L, STG1M and STG1S start at TDC, and the respective final stages finish at TDC.

Figure 9:
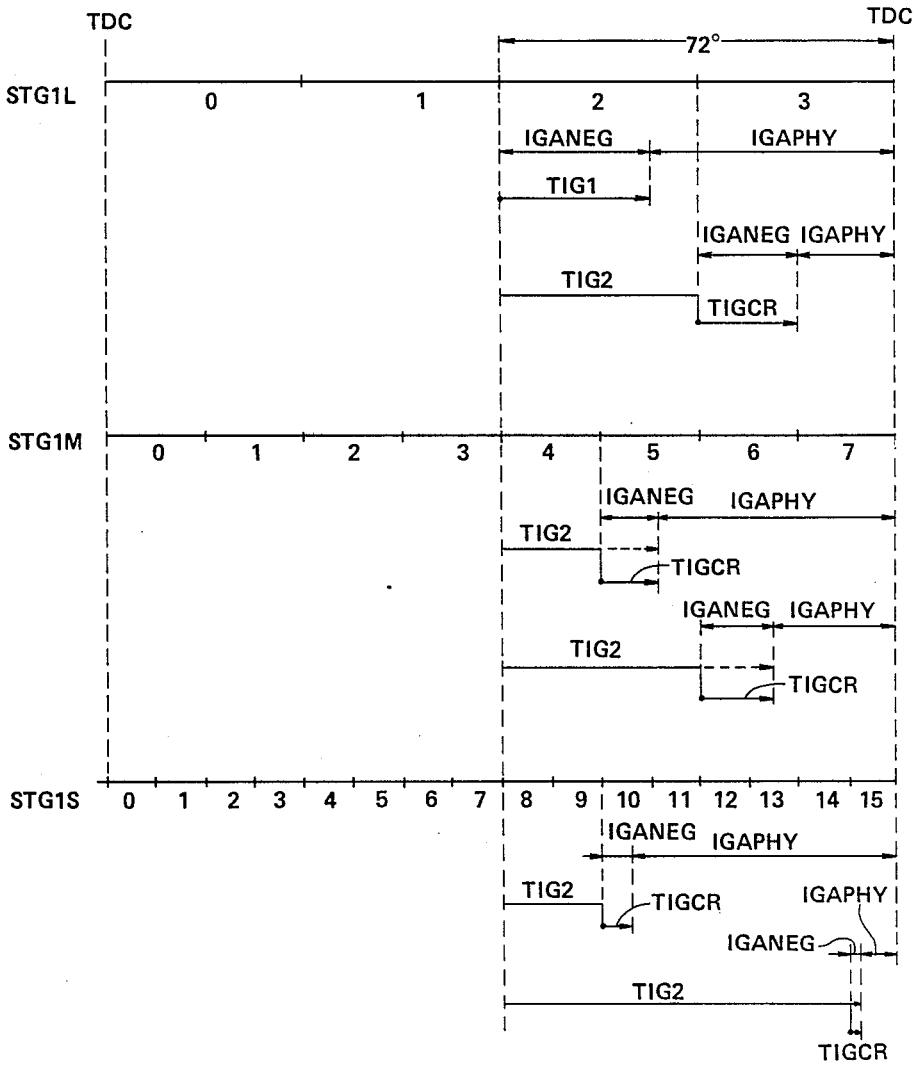
FIG. 9 is a timing chart showing the operation principle of the ignition timer using the embodiments of this invention.

The decision of the ignition correction stage by the ignition output signal producing unit 12, and the ignition timer operational, principle will be explained with reference to FIG. 9.

First, the ignition timer output value TIG for the high speed condition is given based on the formula $$TIG=(100\text{-}IGAPHY)/80 \quad (6).$$

For example, when the ignition lead angle value is 36° to 72°, stage 2 of STG1L is the ignition correction stage. Further, when the ignition lead angle value is 0° to 30°, stage 3 of STG1L is the ignition correction stage. However, the stage where the ignition timer output value TIG is actually counted down (hereinafter called SIGCRL) is given in a value of the sum of a quotient (an integer) of Formula (6) and 2. The ignition timer output value TIG is given by the remainder of Formula (6) IGANEG which has been timely converted. Accordingly, as shown in FIG. 9, the value (100-IGAPHY) of the numerator of Formula (6) is 80 or less, SIGCRL becomes stage 2 of STG1L, and only the ignition timer output value TIG which is the remainder IGANEG timely converted is counted down by a counter which will be explained below. When (100-IGAPHY) is 80 or more and 160 or less, SIGCRL becomes stage 3, and the ignition timer output value is a value TIGCR which is the remainder IGANEG timely converted.

Next, the ignition timer output value TIG for the medium speed condition is given by the next Formula $$TIG=(100\text{-}IGAPHY)/40 \quad (7).$$

In this case, when the ignition lead angle is 54° to 72°, STGIM becomes stage 4. When the ignition lead angle is 36° to 54°, STGIM becomes, stage 5. When the ignition lead angle is 18° to 36°, STGIM becomes stage 6. When the ignition lead angle is 0° to 18°, STGIM becomes stage 7. In the medium speed condition, however, a stage where an ignition timer output value TIG (hereinafter called SIGCRM) is actually counted down is given by a value of a sum of a quotient of Formula (7) and 4.

The ignition timer output value TIG is given by converting timely a remainder of Formula (7) IGANEG. Accordingly, as shown in FIG. 9, when the numerator of Formula (7) (100-IGAPHY) is, for example, 40 or more and 80 or less, SIGCRM becomes state 5 of STG1M. Further, TIGCR which is the remainder of Formula (7) IGANEG timely converted, gives an ignition timer output value. When (100-IGAPHY) is 80 or more and 120 or less, SIGCRM become stage 6 of STGIM, and a value TIGCR, into which the remainder STGIM is timely converted, becomes the ignition timer output value.

Finally, the ignition timer output value TIG for the low speed condition is calculated based on the following formula $$TIG=(100\text{-}IGAPHY)/20 \quad (8).$$

In this case, the ignition correction stage is determined by an ignition lead angle value at an interval of 9° in the range from stages 8 to 15. A stage where an ignition timer output value TIG is actually counted down (hereinafter called SIGCRS) is given in a value of a sum of a quotient (an integer) of Formula (8) and 8. An ignition timer output value TIG is given in a value of the remainder of Formula (8) timely converted. Accordingly, as shown in FIG. 9, the numerator of Formula (8) (100-IGAPHY) is, for example, 40 or more and 60 or less, SIGCRS becomes stage 10 of STGlS. Further, a value TIGCR, into which the remainder of Formula (8) is timely converted, becomes an ignition timer output value. When (100-IGAPHY) is 140 or more and less than 160, SIGCRS becomes stage 15 of STG1S, and a value TIGCR into which the remainder IGANEG of Formula (8) is timely converted becomes an ignition timer output value.

As described above, for example, when the ignition timing is within stage 2 for the high speed condition, the ignition timer output value TIG, the count down period of time of the counter, which will be explained below, is so short that even if an engine rotation number abruptly changes, little influence is given to the ignition control. There is no problem. When the ignition timing is in stage 3, however, the count down period of time becomes longer. Within this count down period of time, the ignition timing cannot be corrected even when an engine rotation number abruptly changes. Resultantly, an error takes place. As an engine reduces its rotation number, the instability of the engine condition becomes higher, and errors become larger. Accordingly the control must be precise.

In this invention, when a difference (=100-IGAPHY) given by subtracting an ignition control value IGAPHY from an ignition control range (=72°) is out of stage 1 of STG1L, an ignition timer output value TIG2 to be set at the starting time of stage 2 of STG1L, and an ignition timer output value TIGCR to be set at the starting time of stage 3 thereof are calculated beforehand, and the contents of an ignition timer output value at the starting time of stage 3 is rewritten into a corrected value TIGCR, so that an error of an ignition timing is made small when an engine rotation number abruptly changes during a count down period of time. Further, the stage interval becomes smaller as running condition of the engine changes to the medium speed condition and then to the low speed condition. This is that more precise control can be performed for lower speeds.

Next, the decision of the current charge starting stage, and the operational principle of the current charge timer, will be explained with reference to FIG. 10.

Figure 10A:
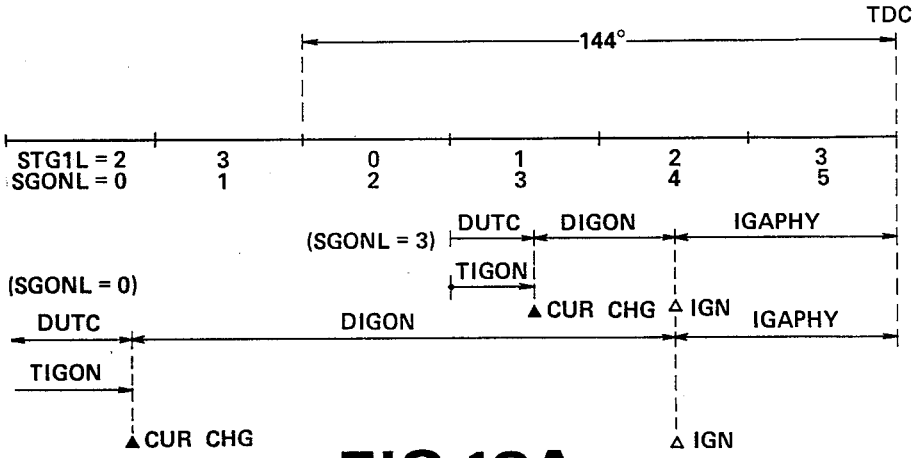
FIGS. 10*a*, 10*b* and 10*c* are timing charts showing the operation principle of the current charge timer using the embodiments of this invention.

FIG. 10A shows the current charge starting stage for the high speed condition. Here, SGONL is STG1L numbered sequentially up to the initial TDC with two stages of the above described STG1L delayed. Accordingly stage 2, 3, 0, 1, 2, 3 of STG1L correspond to stage 0, 1, 2, 3, 4, 5 of SGONL. In this case, the control of the current charge starting time is performed, based on a current charge starting stage SGONL calculated by Formula (2) and DUTC. Specifically, when a value which is a sum of a no current charge angle IGAOFF, and a hexadecimal value (100-IGAPHY) given by subtracting an ignition lead angle from an ignition control range, with respect to the ignition control range (hereinafter called a value of the numerator of Formula (2)) is 240 or more and 320 or less as shown in FIG. 10A, the current charge starting stage becomes stage 3 of SGONL. Further, a value TIGON into which the remainder of Formula (2) DUTC is timely converted becomes the current charge timer value. Similarly, when the numerator of Formula (2) is 0 or more and 80 or less, the current charge starting stage becomes stage 0 of SGONL, and a value TIGON into which the remainder DUTC is timely converted is the current charge timer value.

Figure 10B:
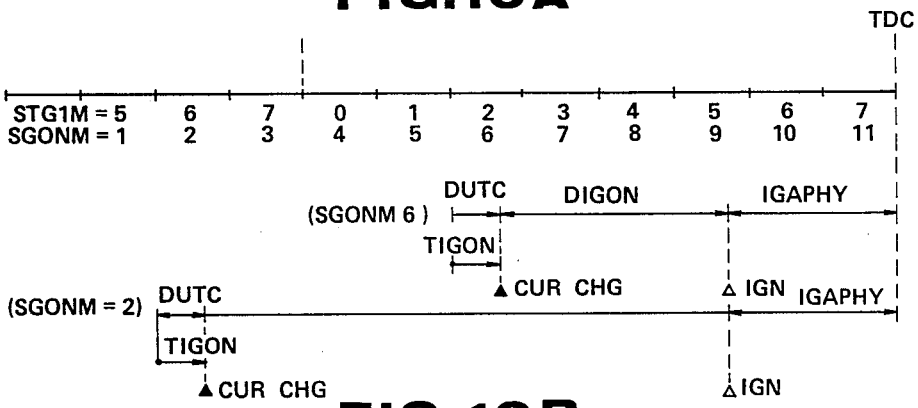

The ignition timer output value TIG for the medium speed condition is given based on SGONM and DUTC given by Formula (4). When a value of the numerator of Formula (4), 55 (IGAOFF+100)-IGAPHY}, is 200 or more and 240 or less as shown in FIG. 10B, the current charge starting stage becomes s&age 6 of SGONM, and a value, TIGON into which the remainder of Formula (4) is timely converted becomes the current charge timer value. Similarly the numerator of Formula (4) is 80 or more and 120 or less, the current charge starting stage becomes stage 2 of SGONM and a value TIGON into which the remainder DUTC is timely converted, becomes the current charge timer value. Here, SGONM is STGIM numbered sequentially up to the initial TDC with two stages of the above described STG1L delayed. Accordingly stage 4, 5, 6, 7, 0, . . . , 6, 7 of STGIM correspond to stage 0, 1, 2, 3, 4, . . . , 10, 11 of SGONM.

Figure 10C:
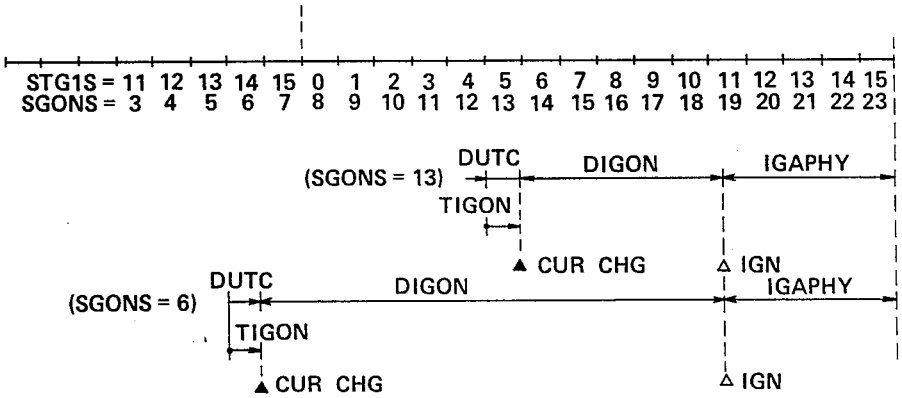

The ignition timer output value TIG for the low speed condition is given, based on SGONS and DUTC calculated by Formula (5). When a value of the numerator of Formula (5) (IGAOFF+100)-IGAPHY is, for example, 260 or more and 280 or less as shown in FIG. 10C, the current charge starting stage becomes stage 13 of SGONS. Thus, a value TIGON into which the remainder DUTC is timely converted becomes the current charge timer value. Similarly, when the numerator of Formula (5) is 120 or more and 140 or less, the current charge starting stage becomes stage 6 of SGONS, and a value TIGON in&o which the remainder is timely converted becomes the current charge timer value. Here, SGONS is STG1S numbered sequentially up to the initial TDC with two stages of the above described STG1L delayed. Accordingly, stage 8, 9, 10, . . . , 0, 1, 2, . . . , 13, 14, 15 of STG1S correspond to stage 0, 1, 2, . . . , 8, 9, 10, . . . , 21, 22, 23 of SGONS.

Since a crank angle position range (hereinafter called "current charge starting range"), where a current charge can be started, is extended over six stages (=216°) of STGlL for a five cylinder engine, a subtraction count by clock pulses takes so long a period of time that a current charge starting stage is delayed. Further, when a change in an engine rotation number takes place during the subtraction count, an error takes place in a current charging time which is a function of an engine rotation number NE. Resultantly, a suitable current charge cannot be performed. In this invention, however, for the purpose of shortening a period of time for a subtraction count, a current charge starting stage which is nearest to a current charge starting stage is given out of a current charge starting range by the above described calculation. Thus, influences due to changes in an engine rotation number can be minimized.

As the speed mode is lower, the engine rotation number NE becomes more unstable, and it takes a longer period of time to obtain a required crank angle. In view of this, stages of higher resolution are used for the low speed mode so as to enable the control to be more precise. Specifically, for the high speed condition, when a long period of time is required for the current charge (DIGON is large), as shown in FIG. 10A, the required calculation results in that stage 0 of SGONL becoming the current charge starting stage. When a long period of time is not required for the current charge (DIGON is small), a stage nearest to a current charge starting time, for example, stage 3 of SGONL is assigned by the required calculation, and a subtraction count is performed. In other words, in this invention, the crank angle range (=DUTC) in which the subtraction count takes place within one stage (=36°) of SGONL1 for the high speed condition, within one stage (=18°) of SGONM1 for the medium speed condition, and within one stage (=9°) of SGONS1 for the low speed condition. Thus, as the speed mode is lower, the control can be more precise so that influences due to changes in an engine rotation number can be minimized.

Figures 11, 12:
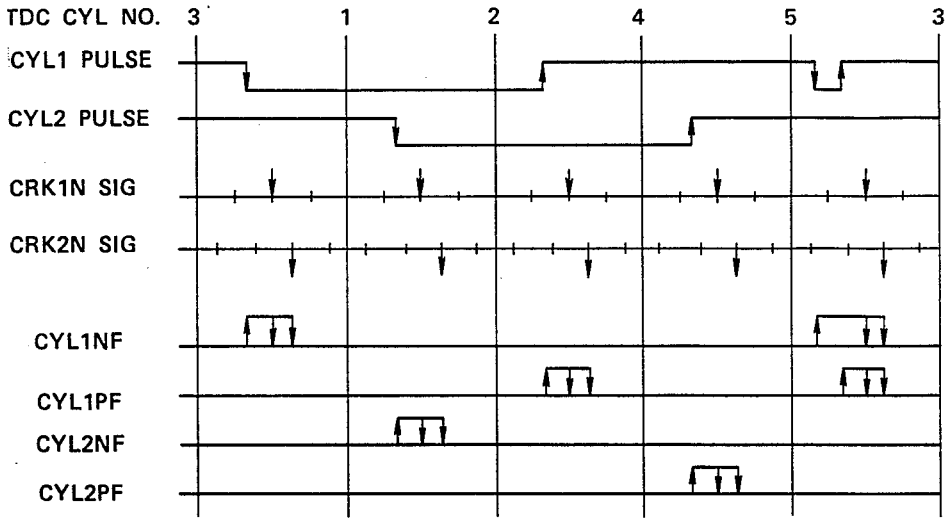
FIG. 11 is a diagram of the signal waveforms showing the cylinder identifying data preparation method using the embodiments of this invention.
FIG. 12 is truth table for identifying a cylinder based on a cylinder identifying data of FIG. 11.

Next, the principle of preparing a cylinder identifying data by the cylinder identifying data preparing unit 13 will be explained with reference to FIGS. 11 and 12.

The cylinder identification is performed based on inputs of the positive or negative inversed edge signals of CYL1 and CYL2 pulses. The positively and negatively inversed edges of CYL1 pulse or CYL2 pulse, which are shaped into square waves by, for example, a waveform shaping circuit from the sine waves inputted by the timing sensors 1,2, are detected by, for example, a latch circuit. As shown in FIG. 11, the cylinder identifying data includes, in addition to these signals detected by the latch circuit, the negatively inversed edge signals of CRK1 pulse and/or CRK2 pulse and is prepared in accordance with the truth table shown in FIG. 12. To give an example, when the cylinder to output an ignition output signal next is a first cylinder, the latch circuit outputs 1 in response to the input of a negatively inversed edge signal of CYL1 pulse, and the output 1 is used as a flag for the negatively inversed edge signal of CYL1 pulse (hereinafter called CYL1NF). Following negatively inversed edge signal(s) of CRK1 pulse and/or CRK2 pulse is (or are added to the flag, and a cylinder identifying data is prepared. In this case, even if no negatively inversed edge signal of CYL1 pulse should be supplied due to a level shortage or other faults, a signal 0 is generated because no positively inversed edge signal of CYL1 pulse is supplied. This arrangement is for causing no trouble to the cylinder identification even in a possible failure that the edge signals of CYL1 pulse on one side are not detected.

When the CRK1 pulse is in failure, the CRK2 pulse is detected to prepare a cylinder identifying data. The truth table contains arbitrary combinations of the positively and negatively inversed edges of CYL1 pulse, and the positively and negatively inversed edges of CYL2 pulse, etc. A cylinder identifying data, thus prepared, is supplied to the ignition output distributing unit 14 together with an ignition timer value and a current charge timer value produced by the ignition output signal producing unit 12.

The ignition output distributing unit 14 supplies a current to a relevant cylinder in response to the supplied cylinder identifying data at the timing based on the supplied current charge starting value. It then ignites the relevant cylinder, based on the supplied ignition timer value. Specifically, the counter begins to count on a current charge starting stage, and when the count becomes 0 (when a current charge timer value TIGON has passed since the current charge starting stage), a current charge starts to be supplied. Similarly, the counter starts to count on an ignition timer correcting stage, and when the count becomes 0 (an ignition timer value TIG has passed since the ignition timer correcting stage), a current supply to the secondary coil is interrupted, and a relevant cylinder is ignited.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

I claim:

1. An electronic control ignition system for an internal combustion engine in which crank angle signals, each generated every time the crank shaft of the internal combustion engine rotates by a predetermined angle, are detected and an ignition timing is controlled based on the detected crank angle signals, the system comprising:

primary pulse generating means for generating a first train of pulses, each pulse having a fall time and a rise time and being generated every time said crank shaft rotates by said predetermined angle;

secondary pulse generating means for generating at least one second pulse train, subsequent to said first train of pulses, wherein each said second pulse train generated is sequentially delayed in phase with respect to an immediately previously generated pulse train;

speed detection means, operatively connected to said primary and secondary pulse generating means, for detecting rotational velocity of said engine, said speed detecting means further outputting a signal indicating that said rotational velocity is operating in one of either a first velocity within predetermined velocity range, a second velocity above said predetermined velocity range, and a third velocity below a predetermined velocity range;

error detection means, operatively connected to said primary and secondary pulse generating means, for detecting errors in said generated pulse trains and for outputting a signal indicating errors in said generated pulse trains; and selectable switching means, including a plurality of switches, operatively connected to said primary pulse generating means, said secondary pulse generating means, said error detection means, and said speed detection means, for selectively operating certain of said plurality of switches to continuously detect at least one of said first and second pulse trains to thereby continuously monitor and control ignition timing of said internal combustion engine, said selective operation of certain of said plurality of switches being responsive to said output signal of said speed detection means and said output signal of said error detection means.

2. A system as claimed in claim 1, wherein said secondary pulse generating means generates second pulse trains, where n is an even number greater than or equal to 4, which are sequentially delayed in phase from a previously generated pulse train by T/n, where T is the period equal to an amount of time between the rise times of consecutive pulses.

3. A system as claimed in claim 2, wherein said plurality of switches is equal in number to n.

4. A system, as claimed in claim 3, wherein said selectable switching means further comprises:

pulse edge detecting means, operatively connected to said first and second pulse generating means and said plurality of switches, for detecting each positive edge of each pulse corresponding to said pulse rise time and outputting positive edge signals to said plurality of switches, and for detecting each negative edge of each pulse corresponding to said pulse fall time and outputting negative edge signals to said plurality of switches.

5. A system as claimed in claim 4, wherein said pulse edge detection means comprises a plurality of flip-flops.

6. A system as claimed in claim 5, wherein said plurality of flip-flops are D-flip-flops.

7. A system, as claimed in claim 4, wherein said pulse edge detecting means outputs a plurality of edge signals equal in number to n, each of said output plurality of edge signals corresponding to one of said plurality of switches.

8. A system, as claimed in claim 4, wherein said pulse edge detecting means outputs a plurality of positive edge signals corresponding to said plurality of pulses in said first pulse train, a plurality of negative signals corresponding to said plurality of pulses in said first pulse train, and a plurality of positive and negative edge signals corresponding to each of said second pulse trains.

9. A system, as claimed in claim 1, wherein said output signal of said speed detection means is input to said selectable switching means to switch on certain of said plurality of switches, said certain of said plurality of switches being dependent upon either of said first, second, or third velocity detected.

10. A system, as claimed in claim 9, wherein the number of switches selected is equal to 1 for said second velocity detected, at least 2 for said first velocity detected, and n for said third velocity detected, thereby allowing for increased precision in controlling ignition timing when said engine is operating below a predetermined velocity range.

11. A system, as claimed in claim 1, wherein said error detection means continuously detected each of said plurality of pulse trains generated by said first and second pulse generating means and outputs a signal to said selectable switching means upon not detecting at least one of said plurality of pulse trains, thereby detecting an error.

12. A system, as claimed in claim 11, wherein said output signal from said error detection means to said selectable switching means indicates which of said plurality of pulse trains have not been detected.

13. A system, as claimed in claim 12, wherein said selectable switching means, upon receiving said output signal from said error detection means, opens said plurality of switches corresponding to said pulse trains which have not been detected, to thereby render said open switches inoperable to continuously detect corresponding pulse trains and further inoperable to continuously monitor and control ignition timing of said internal combustion engine, due to said detected error.

14. A system, as claimed in claim 13, wherein said secondary pulse generating means generates second pulse trains, where n is an even number greater than or equal to 4, at which are sequentially delayed from a previously generated pulse train by T/n, where T is the period equal to an amount of time between the rise times of consecutive pulses.

15. A system as claimed in claim 14, wherein said plurality of switches is equal in number to n.

16. A system, as claimed in claim 15, wherein said selectable switching means further comprises:

pulse edge detecting means, operatively connected to said first and second pulse generating means and said plurality of switches, for detecting each positive edge of said pulse corresponding to said pulse rise time and outputting positive edge signals to said plurality of switches, and for detecting each negative edge of each pulse corresponding to said pulse fall time and outputting negative edge signals to said plurality of switches.

17. A system, as claimed in claim 16, wherein said pulse edge detection means comprises a plurality of flip-flops.

18. A system, as claimed in claim 17, wherein said plurality of flip-flops are D-flip-flops.

19. A system, as claimed in claim 16, wherein said pulse edge detecting means outputs a plurality of edge signals equal in number to n, each of said output plurality of edge signals corresponding to one of said plurality of switches.

20. A system, as claimed in claim 16, wherein said pulse edge detecting means outputs a plurality of positive edge signals corresponding to said plurality of pulses in said first pulse train, a plurality of negative signals corresponding to said plurality of pulses in said first pulse train, and a plurality of positive and negative edge signals corresponding to each of said second pulse trains.

21. An electronic control ignition system for an internal combustion engine in which crank angle signals, each generated every time the crank shaft of the internal combustion engine rotates by a predetermined angle, are detected and an ignition timing is controlled based on the detected crank angle signals, the system comprising:

primary pulse generating means for generating a first train of pulses, each pulse having a fall time and a rise time and being generated every time the crank shaft rotates by the predetermined angle;

secondary pulse generating means for generating at least one second pulse train, subsequent to said first train of pulses, wherein each said second pulse train generated is sequentially delayed in phase with respect to an immediately previously generated pulse train; and selectable switching means, including a plurality of switches, operatively connected to said primary pulse generating means and said secondary pulse generating means, for selectively operating certain of said plurality of switches to continuously detect at least one of said first and second pulse trains, thereby continuously monitoring and controlling ignition timing of said internal combustion engine.

22. The system as claimed in claim 21, further comprising:

speed detection means, operatively connected to said primary and secondary pulse generating means, for detecting a rotational velocity of the engine, said speed detecting means further outputting a velocity signal indicating that said rotation velocity is operating in one of either a first velocity within predetermined velocity range, a second velocity above said predetermined velocity range, or a third velocity below a predetermined velocity range;

said selectable switching means being responsive to said velocity signal of said speed detection means.

23. The system as claimed in claim 21, further comprising:

error detection means, operatively connected to said primary and secondary pulse generating means, for detecting errors in said generated pulse trains and for outputting an error signal indicating errors in said generated pulse trains;

said selectable switching means being responsive to said error signal of said error detection means.

24. The system as claimed in claim 21, wherein said secondary pulse generating means generates ((n/2)-1) second pulse trains, where n is an even number greater than or equal to 4, said second pulse trains being sequentially delayed in phase from a previously generated pulse train by T/n, where T is the period equal to an amount of time between the rise times of consecutive pulses.

25. The system as claimed in claim 24, wherein said plurality of switches is equal in number to n.

26. The system as claimed in claim 25, wherein said selectable switching means further comprises:

pulse edge detecting means, operatively connected to said first and second pulse generating means and said plurality of switches, for detecting each positive edge of each pulse corresponding to said pulse rise time and outputting positive edge signals to said plurality of switches and for detecting each negative edge of each pulse corresponding to said pulse fall time and outputting negative edge signals to said plurality of switches.

27. The system as claimed in claim 26, wherein said pulse edge detecting means outputs a plurality of edge signals equal in number to n, each of said signals corresponding to one of said plurality of switches.

28. The system as claimed in claim 24, wherein said pulse edge detecting means outputs a plurality of positive edge signals corresponding to said plurality of pulses in said first pulse train, a plurality of negative signals corresponding to said plurality of pulses in said first pulse train, and a plurality of positive and negative edge signals corresponding to each of said ((n/2)-1) second pulse trains.

29. The system as claimed in claim 22, wherein said velocity signal of said speed detection means is inputted to said selectable switching means to switch on certain of said plurality of switches, said certain switches being dependent upon either of said first, second, or third velocity detected.

30. The system as claimed in claim 29, wherein the number of switches selected is equal to 1 for said second velocity detected, at least 2 for said first velocity detected, and n for said third velocity detected, thereby allowing for increased precision in controlling ignition timing when said engine is operating below a predetermined velocity range.

31. The system as claimed in claim 23, wherein said error detection means continuously detects each of said plurality of pulse trains generated by said first and second pulse generating means and outputs said error signal to said selectable switching means upon not detecting at least one of said plurality of pulse trains, thereby detecting an error.

32. The system as claimed in claim 31, wherein said error signals outputted from said error detection means to said selectable switching means indicates which of said plurality of pulse trains has not been detected.

33. The system as claimed in claim 32, wherein said selectable switching means, upon receiving said error signal from said error detection means, opens said plurality of switches corresponding to said pulse trains which have not been detected, thereby rendering said open switches inoperable to continuously detect corresponding pulse trains and further inoperable to continuously monitor and control ignition timing of the internal combustion engine in response to said detected error.

34. The system as claimed in claim 33, wherein said secondary pulse generating means generates ((n/2)-1) second pulse trains, where n is an even number greater than or equal to 4, said second pulse trains are sequentially delayed from a previously generated pulse train by T/n, where T is the period equal to an amount of time between the rise times of consecutive pulses.

35. The system as claimed in claim 34, wherein said plurality of switches is equal in number to n.

36. The system as claimed in claim 35, wherein said selectable switching means further comprises:

pulse edge detecting means, operatively connected to said first and second pulse generating means and said plurality of switches, for detecting each positive edge of said pulse corresponding to said pulse rise time and outputting positive edge signals to said plurality of switches and for detecting each negative edge of each pulse corresponding to said pulse fall time and outputting negative edge signals to said plurality of switches.

37. The system as claimed in claim 36, wherein said pulse edge detecting means outputs a plurality of edge signals equal in number to n, each of said output plurality of edge signals corresponding to one of said plurality of switches.

38. The system as claimed in claim 36, wherein said pulse edge detecting means outputs a plurality of positive edge signals corresponding to said plurality of pulses in said first pulse train, a plurality of negative signals corresponding to said plurality of pulses in said first pulse train, and a plurality of positive and negative edge signals corresponding to each of said ((n/2)-1) second pulse trains.

* * * * *